US005295864A

United States Patent [19]

Birch et al.

[11] Patent Number: 5,295,864

[45] Date of Patent: Mar. 22, 1994

[54] SEALED COAXIAL CONNECTOR

[75] Inventors: Norman R. Birch, Jacobus; Nathan J. Norris, Evans City, both of Pa.

[73] Assignee: The Whitaker Corporation, Wilmington, Del.

[21] Appl. No.: 43,313

[22] Filed: Apr. 6, 1993

[51] Int. Cl.[5] ..... H01R 9/05

[52] U.S. Cl. ..... 439/578; 439/271; 439/434

[58] Field of Search ..... 439/578-585, 439/675, 271, 877, 278, 281, 434

[56] References Cited

U.S. PATENT DOCUMENTS

| | | | |
|---|---|---|---|
| 3,428,739 | 2/1969 | Jackson | 439/585 |
| 3,539,709 | 11/1970 | Brancelone | 439/585 |
| 3,683,320 | 8/1972 | Woods | 439/584 |
| 3,976,352 | 8/1976 | Spinner | 339/177 R |
| 4,305,638 | 12/1981 | Hutter | 339/177 R |
| 4,408,822 | 10/1983 | Nikitas | 339/177 R |
| 4,674,818 | 6/1987 | McMills et al. | 439/275 |
| 4,687,272 | 8/1987 | Spinner et al. | 439/271 |
| 4,696,532 | 9/1987 | Mattis | 439/863 |
| 4,717,355 | 1/1988 | Mattis | 439/452 |
| 4,746,305 | 5/1988 | Nomura | 439/319 |
| 4,795,370 | 1/1989 | Freitag | 439/584 |
| 4,834,675 | 5/1989 | Samchisen | 439/578 |
| 4,867,703 | 9/1989 | Flanagan et al. | 439/578 |
| 4,902,246 | 2/1990 | Samchisen | 439/578 |
| 4,979,911 | 12/1990 | Spencer | 439/583 |
| 5,002,503 | 3/1991 | Campbell et al. | 439/578 |
| 5,007,861 | 4/1991 | Stirling | 439/578 |
| 5,011,432 | 4/1991 | Sucht et al. | 439/584 |
| 5,083,943 | 1/1992 | Tarrant | 439/583 |

FOREIGN PATENT DOCUMENTS 2199197 6/1988 United Kingdom .

*Primary Examiner*—David L. Pirlot
*Attorney, Agent, or Firm*—William B. Noll

[57] ABSTRACT

The invention hereof relates to an improved Type "F" connector, where the contact and ground interfaces are sealed from the outside environment. The connector comprises a connector body, a dielectric insert to be received within the connector body, where the insert includes a generally uniform central bore, a metal wedge member featuring at least one annular serration, about a conically configured end thereof, where the wedge member is received within the insert and the serration is spaced from the wall of the bore prior to assembly of the connector. During assembly of the coaxial cable, the metal braid and jacket are captured between the serrations and the wall of the insert bore. Finally, elastomeric sealing means are provided at each end of the connector to environmentally protect same.

5 Claims, 5 Drawing Sheets

SEALED COAXIAL CONNECTOR

This invention is directed to a sealed coaxial connector, particularly to a class of connectors known in the art as Type "F" connectors, where the contact and ground interfaces are sealed from the outside environment to prevent corrosion thereof.

By way of brief background, this class of connectors have gained widespread use in cable television distribution systems. Such cables typically include a solid central conductor which is surrounded by a core of low loss, high dielectric characteristic material, usually a plastic foam. A metal, e.g. aluminum, cylindrical outer braid and foil jacket, providing a signal return path, concentrically surrounds the central conductor and contains the dielectric material. The cable is protected by a non-conductive sheathing which surrounds the outer metal jacket and prevents moisture from reaching the jacket or the interior of the cable.

In order for the cable to be used effectively, a connector is typically provided for attachment at an end thereof. Once installed, the connector may then serve as an interface between the cable and distribution amplifiers or panels; or, alternatively, the connector may be double-ended and serve as an appliance to splice two cable ends together.

The ends of television distribution coaxial cable, such as RG 59, are typically prepared by the craftsperson/installer in order to receive the cable connector. Such preparation typically comprises removal of the outer sheathing and metal braid and foil jacket for about one half inch, and removal with a standard coring tool of the foam core between the jacket and the central conductor for a distance of about one inch in order to receive a conductive mandrel against which the outer jacket and sheathing are clamped by the connector. In using connectors the outer plastic sheathing material is removed for some longitudinal distance of cable at the end, so that a split ring ferrule may directly engage and clamp the outer metal jacket to the mandrel. Reference is made to U.S. Pat. No. 5,011,432 to such et al for a further explanation thereof, and some of the concerns associated with such connectors. One such concern is the provision of a means to seal the connector against the intrusion of moisture which may corrode metal parts, thereby affecting performance.

U.S. Pat. No. 4,674,818 to McMills et al teaches a simplified sealing arrangement between a coaxial cable connector and a fixed coaxial cable box, such as a CATV coaxial cable drop wire box. The sealing arrangement comprises an elastomeric sealing sleeve which overrides the externally threaded coaxial cable box, and the housing of the coaxial cable connector which threadably engages said cable box.

U.S. Pat. No. 4,717,355 to Mattis, teaches a different sealing arrangement. The arrangement relates to a modification of the plug or cable box. Specifically, the plug includes a flange having an end face which has a cross-sectional area substantially less than the cross-sectional area of the threaded portion of the plug. When mated to coupling assembly or cable connector, the end face is urged against an end face of the coupling assembly to form a seal therewith.

The present invention provides for a dual sealing system. The unique features hereof will become apparent from the description which follows, particularly when read in conjunction with the accompanying drawings.

SUMMARY OF THE INVENTION

The preferred embodiment of this invention is directed to a sealed connector for installation on the prepared end of a coaxial cable having a central conductor and a coaxial metal braid spaced therefrom. The connector comprises a connector body, a dielectric insert to be received within the connector body, where the insert includes a generally uniform central bore, a metal wedge member featuring at least one annular serration, about a conically configured end thereof, where the wedge member is received within the insert and the serration is spaced from the wall of the bore prior to assembly of the connector. During assembly of the coaxial cable, the metal braid is captured between the serrations and the wall of the insert bore. Finally, elastomeric sealing means are provided at each end of the connector to environmentally protect same.

DETAILED DESCRIPTION OF PREFERRED EMBODIMENT

Figure 1:
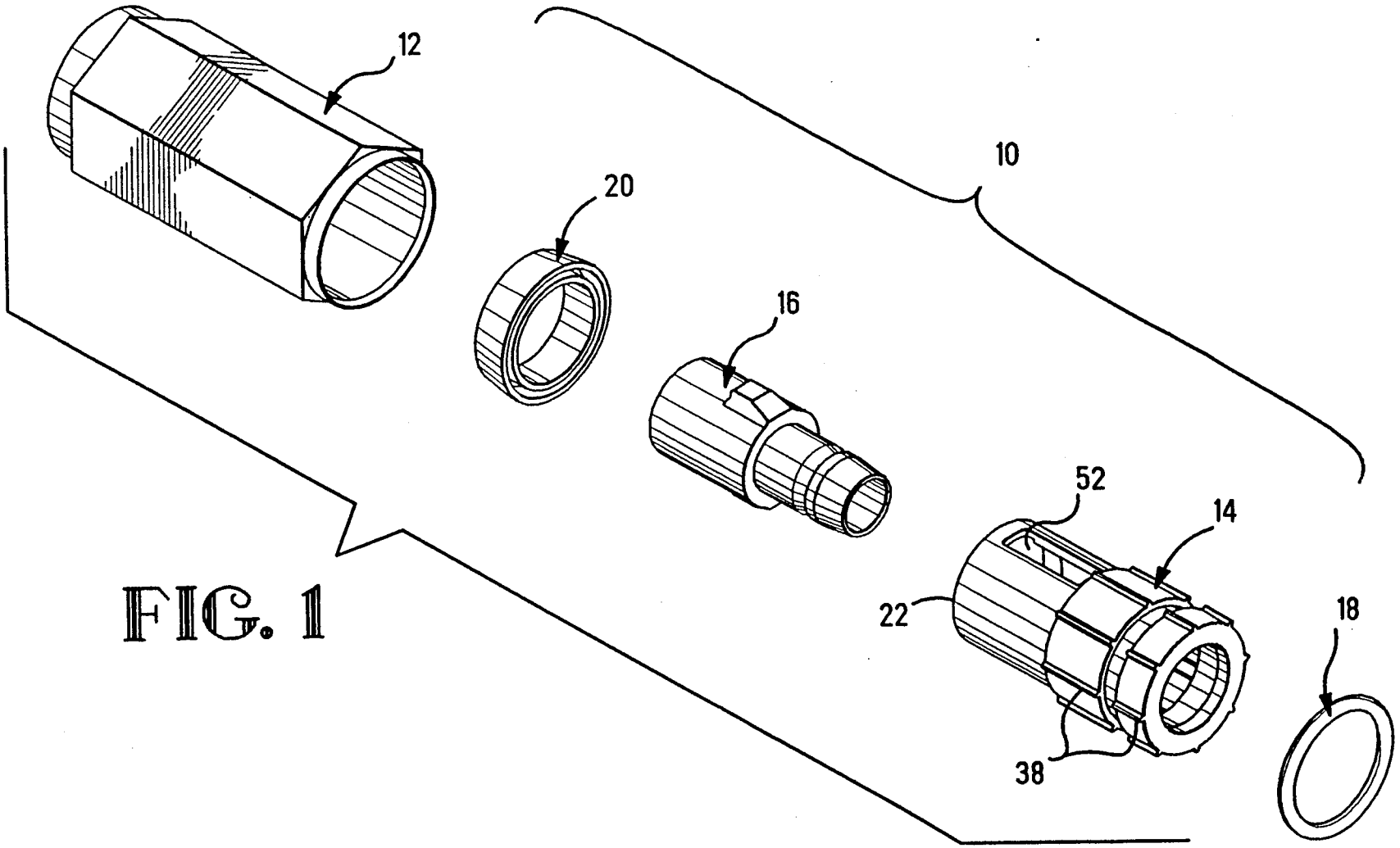
FIG. 1 is an exploded perspective view of the various components forming the sealed coaxial connector according to this invention.

The present invention in its preferred embodiment, relates to a sealed coaxial connector, particularly to a class of connectors known in the art as Type "F" connectors, where the contact and ground interfaces are sealed from the outside environment to prevent corrosion thereof. The major components thereof are illustrated in FIG. 1. While such components are illustrated as axially exploded from one another, it should be noted that the assembly thereof is not necessarily related to the position of the components. The assembly of the connector will be discussed hereinafter.

The connector 10, according to this invention, comprises an essentially circular metal housing 12, such as may be machined from brass, or zinc casting, a dielectric insert 14 adapted to be press fit into said housing 12, a metal wedge member 16 for receipt in said insert 14, and a pair of elastomeric sealing members, such as an O-ring 18 that seats about the insert, and an end cap 20 for engagement with the insert end 22.

Figure 2:
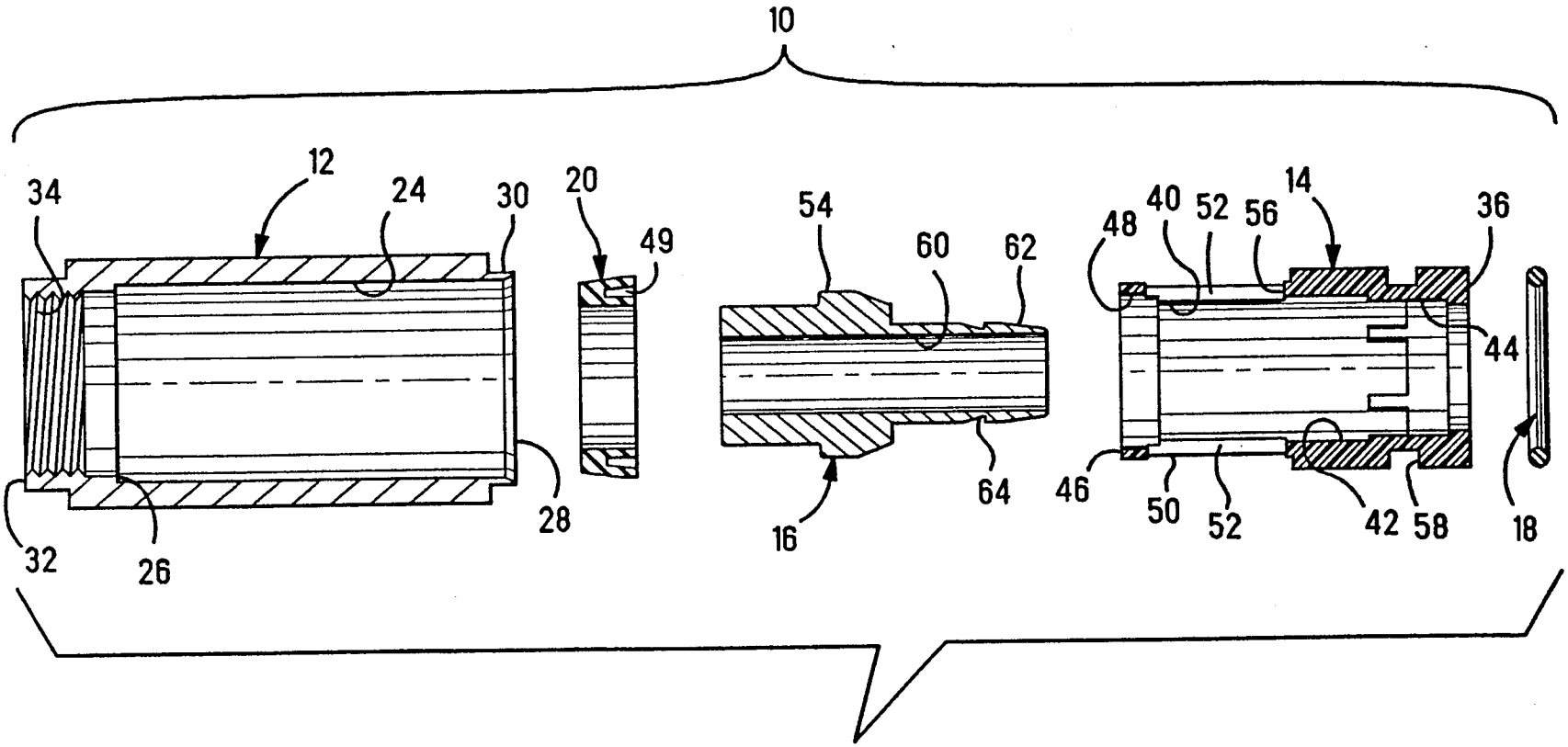
FIG. 2 is an enlarged, exploded sectional view of the connector components of FIG. 1.

Turning now to FIG. 2, where such components are illustrated in section, the housing 12 includes an essentially uniform cavity 24 throughout most of the length thereof, up to an annular inner shoulder 26. The loading end 28 includes a relatively thin annular flange 30 that is deformed in a manner to be described hereinafter. The opposite end 32 of the housing is internally threaded 34 to allow for connection to a signal distribution panel, for example.

The dielectric insert 14, formed of plastic, is essentially a cylindrical shell externally dimensioned at one end 36 thereof to be press fit into the housing cavity 24 up to the shoulder 26. As best seen in FIG. 1, the end 36 may include plural axially oriented ribs 38 that can be more readily deformed or compressed when the insert is loaded into the cavity 24. The insert includes a central bore 40 having plural concentric reduced sections 42, 44, which, as will be apparent hereinafter, cooperate with the wedge member 16 seated therein to capture the metal braid and outer jacket of a coaxial cable secured therewithin.

At its loading end 46, or the end into which the wedge is loaded into the insert 14, an annular groove 48 is provided to accommodate the elastomeric end cap 20. It will be noted that such end cap 20 includes an annular recess 49 to snugly receive the wall of loading end 46. Further, the insert 14, along the shell wall 50, may be provided with a pair of slots 52 to receive radially projecting lances 54 about the wedge 16. Additionally, the forward slot end 56 functions as a stop for axial movement of the wedge 16 relative to the insert 14. Finally, an annular groove 58 is provided about the shell wall 50 into which elastomeric O-ring 18 is seated. Thus, by the use of the two elastomeric sealing members 18, 20, an effective moisture seal is provided between the respective ends of the insert 14 and the wall of cavity 24 of the housing 12.

Figure 3B:
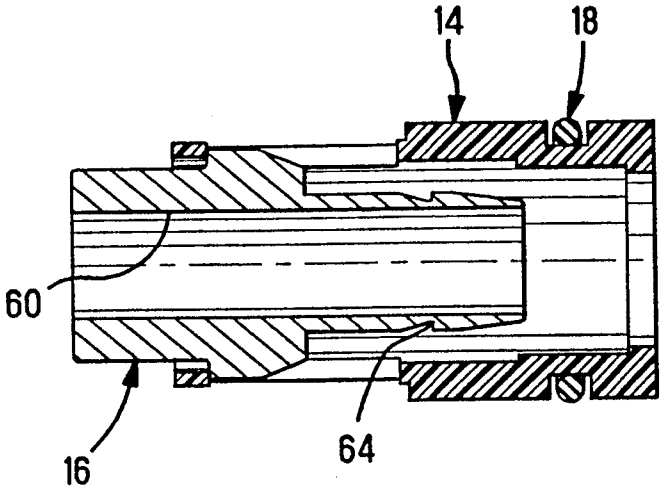
FIG. 3 is a sectional view of a partially assembled connector according to this invention, where a metal wedge member has been received in a dielectric insert.
Figure 4:
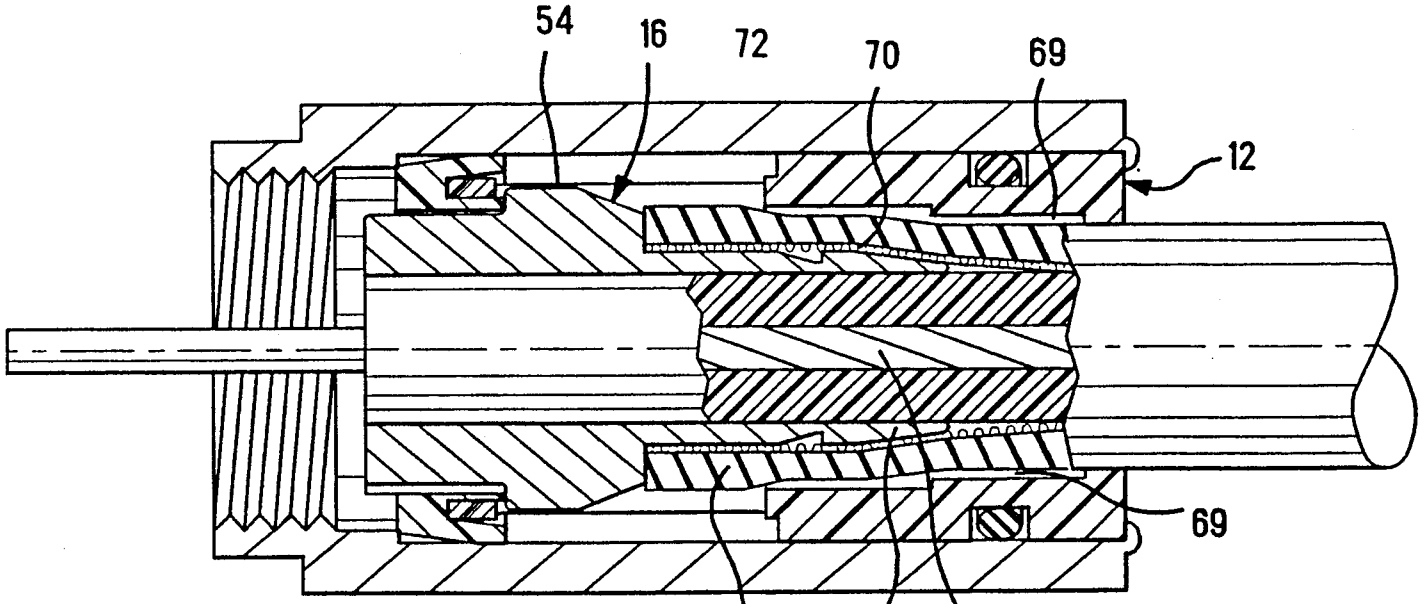
FIG. 4 is a sectional view of the assembled connector hereof, prior to fully capturing the metal grounding braid between the metal wedge member and dielectric insert.
Figure 5:
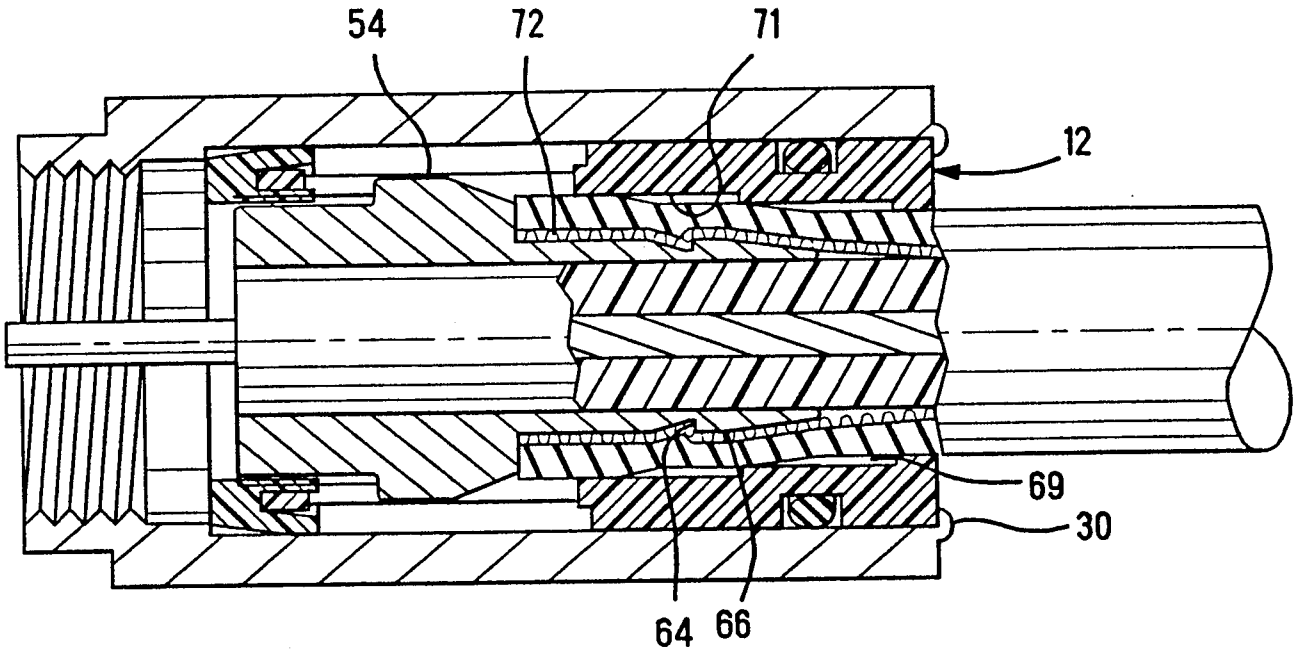
FIG. 5 is a sectional view, similar to FIG. 4, illustrating the fully assembled connector according to this invention.

The metal wedge member 16, to be received into dielectric insert 14, includes a central bore 60 to receive a coaxial cable "C", see FIGS. 3–5, and a conically configured forward end 62, with at least one serration 64 thereabout. The purpose thereof will become apparent in the description accompanying FIGS. 4 and 5.

FIG. 4 represents the position of the various components of the connector of this invention, prior to fully capturing the metal grounding braid 72 between the wedge member 16 and insert 12, where the insulation 70 lies between the metal grounding braid 72 and insert 12. In this position, it will be noted that the insert 12, as determined by the lances 54, is in a forward most position whereby the space 69 between the insert 12 and wedge member 16 is at its greatest. By this arrangement, the insulation layer 70 and metal grounding braid 72 may be readily received therein. Specifically, the outer wrap has been removed to expose the insulation 70 which overlies the metal grounding braid 72, the dielectric medium 74, and eventually the signal core 76. In this forward most position, it will be seen that the conically configured forward end 62 of the wedge member 16 has been inserted between the dielectric medium 74 surrounding the signal transmitting core 76 and the metal grounding braid 72, which in turn underlies the insulation 70, whereby to place the metal braid 72 in grounding contact with the wedge member 16.

The sectional view of FIG. 5 shows the loaded insert assembly. In this assembly, it will be observed that the metal braid 72 has been snugly captured and gripped therein by the compressive action of the outer wall 66 of wedge member 16 through the insulation 70 against the insert inner wall 71, aided by the serration 64 and reduced sectioned bore of the insert. That is, the wedge member 16 has been axially shifted rearwardly, i.e. lances 54 moved to right in FIG. 5, thereby reducing the space 69 to exert a compressive pressure on the metal braid 72 and insulation layer 70.

To summarize, in order to reach the assembly as illustrated in FIG. 5, the preferred steps of assembly are as follows:

a.) insert metal wedge member 16 into dielectric insert 14, where lances 54 seat in respective slots 52, b.) install end cap 20 over end 46 of dielectric insert 14, c.) place O-ring 18 in annular groove 58 (FIG. 3), d.) insert assembly (a-b-c) into housing 12, roll over annular flange 30 to secure assembly, and e.) introduce stripped and prepared cable "C" from rear or end 36 (FIGS. 4 and 5). Thereafter, the assembly may be terminated with a jack, as known in the art.

We claim:

1. A sealed connector for installation on a prepared end of a coaxial cable including a central conductor and a coaxial metal braid spaced therefrom, the connector comprising a connector body, a dielectric insert within said connector body, where said insert includes a generally uniform central bore, a metal wedge member featuring at least one annular serration, where said wedge member is within said insert and said serration is spaced from the wall of said bore, and that said braid is to be captured between said serrations and said wall of the insert bore, and elastomeric sealing means provided at each end of the insert for contact with said connector body, whereby to environmentally seal the connector.

2. The sealed connector according to claim 1, wherein said wedge member includes an axial bore for receiving said central conductor.

3. The sealed connector according to claim 1, where one said elastomeric sealing means comprises an O-ring having a U-shaped cross section, and that said means is adapted to engage an end face of said insert.

4. The sealed connector according to claim 1, wherein said connector body includes a loading end having a deformable flange thereabout, whereby when said connector body receives said insert, said flange is deformed into holding engagement with said insert.

5. The sealed connector according to claim 4, wherein said insert is provided with a plurality of axially arranged ribs to be deformed when the insert is press fit into said connector body.

* * * * *